US011002049B2

(12) United States Patent
Demski et al.

(10) Patent No.: US 11,002,049 B2
(45) Date of Patent: May 11, 2021

(54) QUICK TURN LATCH MECHANISM

(71) Applicant: Deere & Company, Moline, IL (US)

(72) Inventors: Nathan R. Demski, Durango, IA (US); Jacob E. Carlson, Dubuque, IA (US); Cody S. Darling, Dubuque, IA (US); Kurt R. Heine, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 589 days.

(21) Appl. No.: 15/900,263

(22) Filed: Feb. 20, 2018

(65) Prior Publication Data

US 2019/0257126 A1 Aug. 22, 2019

(51) Int. Cl.

| | |
|---|---|
| ***E05B 3/00*** | (2006.01) |
| ***E05D 7/12*** | (2006.01) |
| *E05B 3/02* | (2006.01) |
| *E05D 3/02* | (2006.01) |

(52) U.S. Cl.

CPC ..... *E05D 7/121* (2013.01); *E05B 3/00* (2013.01); *E05D 3/02* (2013.01); *E05D 2007/128* (2013.01); *Y10T 292/0863* (2015.04); *Y10T 292/85* (2015.04)

(58) Field of Classification Search

CPC ..... Y10T 292/0863; Y10T 292/0864; Y10T 292/0886; Y10T 292/0887; Y10T 292/089; Y10T 292/0891; Y10T 292/0892; Y10T 292/85; Y10T 292/93; Y10T 292/96; Y10T 16/458; Y10T 16/459; E05B 3/02; E05B 3/04; E05B 3/00; B60J 5/00; B60J 5/02; B60J 5/0473; E05D 11/00

USPC ..... 296/146.11, 190.11

See application file for complete search history.

(56) References Cited

U.S. PATENT DOCUMENTS

| | | | | |
|---|---|---|---|---|
| 1,799,253 | A * | 4/1931 | Rogers | E05B 3/06 292/350 |
| 2,046,342 | A * | 7/1936 | Muck | E05B 13/005 292/352 |
| 2,185,888 | A | 1/1940 | Donahoe | |
| 2,190,951 | A * | 2/1940 | Roach | E05B 3/06 292/348 |
| 2,368,799 | A | 2/1945 | Barlow | |
| 2,473,937 | A * | 6/1949 | Cameron | E05B 3/04 292/348 |
| 3,169,293 | A | 2/1965 | Neuschotz | |
| 3,397,000 | A | 8/1968 | Nakanishi | |

(Continued)

FOREIGN PATENT DOCUMENTS

DE 102015012101 A1 * 3/2017 ..... B60J 5/00

*Primary Examiner* — Carlos Lugo

(57) ABSTRACT

A latch mechanism having a quick turn and release feature where the latch mechanism comprises a first body member having at least one actuation device. A second body member is coupled to the first body member and includes at least one aperture and pin receiving channel formed therein. A pin element is coupled to the second body member and includes a first pin portion and a second pin portion. The first pin portion and the second pin portion are respectively arranged to extend axially within the pin receiving channel of the second body member such that an upward rotation of the actuation device in a counterclockwise direction releasably disengages the pin element from a shaft of one or more hinges of the door assembly to allow an operator to exit an operator cab of the work vehicle.

20 Claims, 6 Drawing Sheets

(56) References Cited

U.S. PATENT DOCUMENTS

| | | | | | |
|---|---|---|---|---|---|
| 3,891,253 | A * | 6/1975 | Revell | E05C 3/00 | 292/59 |
| 4,471,984 | A * | 9/1984 | Bellantuono | E05B 3/04 | 292/350 |
| 5,584,514 | A * | 12/1996 | Mascotte | E05B 65/1033 | 292/217 |
| 5,690,460 | A | 11/1997 | Attanasio | | |
| 6,357,268 | B1 * | 3/2002 | Takimoto | E05B 17/0025 | 70/208 |
| 6,532,702 | B1 | 3/2003 | Scribner | | |
| 6,655,720 | B2 * | 12/2003 | Rampen | E05B 65/0876 | 292/163 |
| 7,607,553 | B2 | 10/2009 | Weber | | |
| 7,614,117 | B2 | 11/2009 | Selvaraj | | |
| 7,938,479 | B2 | 5/2011 | Tuhy | | |
| 8,100,443 | B2 * | 1/2012 | Talpe | E05B 13/005 | 292/347 |
| 8,567,733 | B2 | 10/2013 | Wang et al. | | |
| 2015/0076840 | A1 * | 3/2015 | Schoch | E05B 81/90 | 292/256 |

* cited by examiner

QUICK TURN LATCH MECHANISM

FIELD OF THE DISCLOSURE

The present disclosure relates generally to latch mechanisms and, more particularly, to a latch mechanism having a quick turn and release feature.

BACKGROUND OF THE DISCLOSURE

In many work vehicles, operator cabs are often designed with insufficient door removal options for rapid exit should a door jam or other issue occur. To address such concerns, some conventional approaches have employed the use of ratcheting devices as operator handles that requires downward clockwise rotation. Drawbacks to such approaches include increased costs, device failure due to wear, delayed release, and/or door jams.

As such, there is a need in the art for an improved and robust latch mechanism that is low cost, easily accessible, and which provides a quick release mechanism for operators.

SUMMARY OF THE DISCLOSURE

According to an aspect of the present disclosure, a latch mechanism for coupling to a door assembly of a work vehicle is disclosed. The latch mechanism comprises a first body member comprising at least one actuation device. A second body member is coupled to the first body member, and has at least one aperture and a pin receiving channel formed therein. A pin element is coupled to the second body member. The pin element includes a first pin portion and a second pin portion respectively arranged to extend axially within the pin receiving channel of the second body member, and wherein the pin element is movable between a first position and a second position in response to an upward rotation of the actuation device in a counterclockwise direction to releasably disengage the latch mechanism from the door assembly.

Other features and aspects will become apparent by consideration of the detailed description and accompanying drawings.

BRIEF DESCRIPTION OF THE DRAWINGS

The detailed description of the drawings refers to the accompanying figures in which.

DETAILED DESCRIPTION OF THE DRAWINGS

Figure 1:
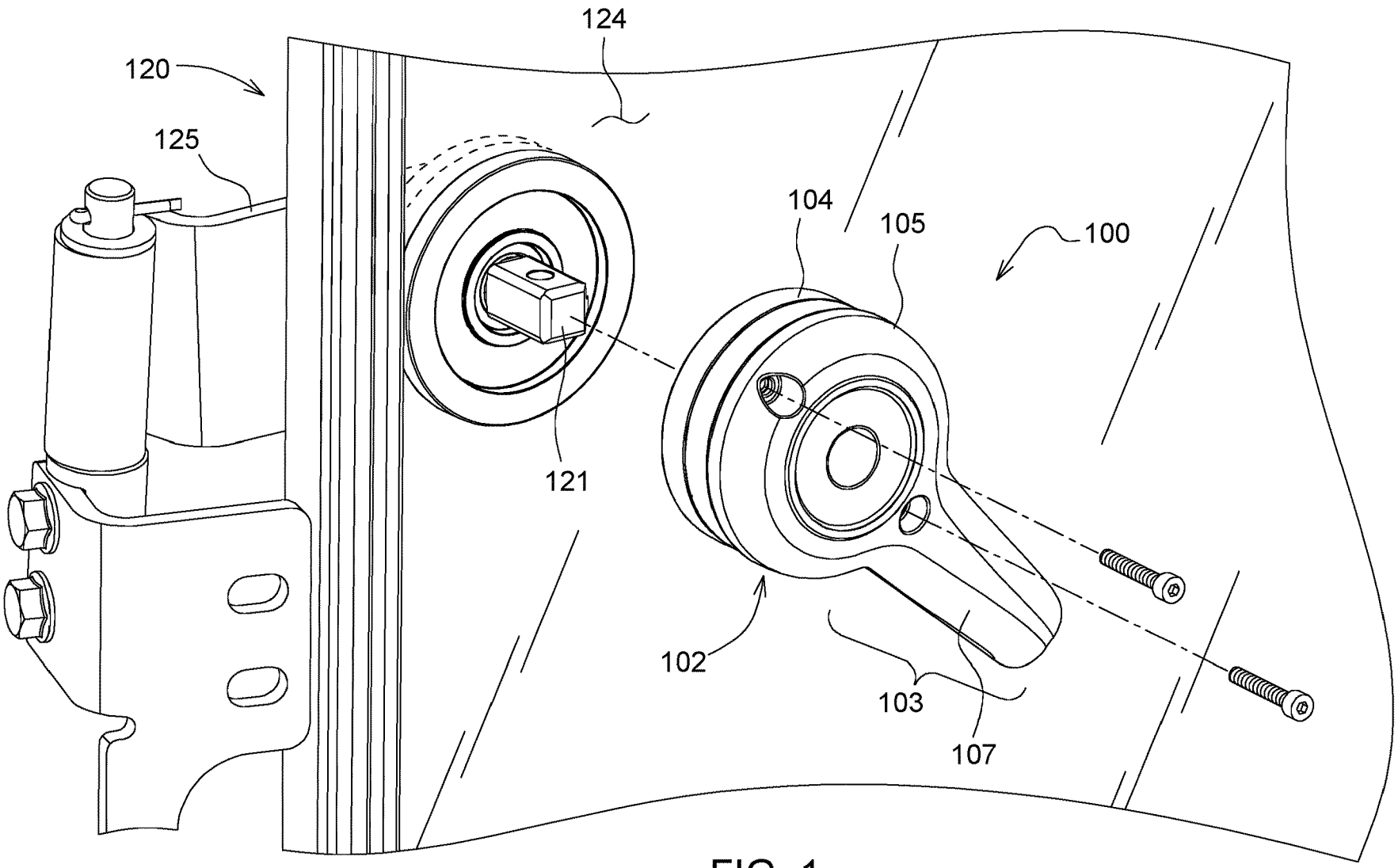
FIG. 1 is a perspective view of a latch mechanism for use with a door assembly according to an embodiment.
Figure 2:
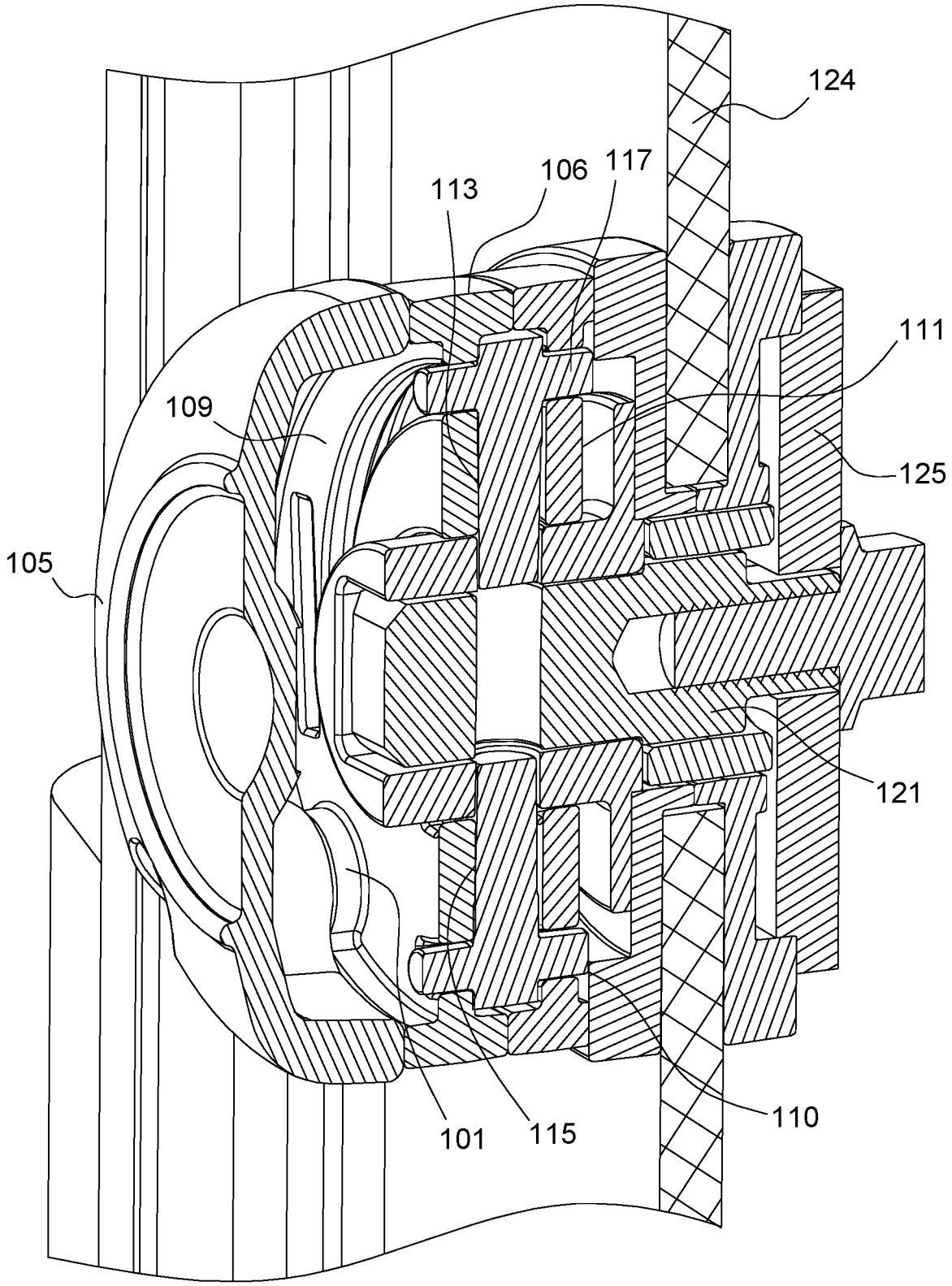
FIG. 2 is a side cross-sectional view of the latch mechanism of FIG. 1 attached to a door assembly according to an embodiment.
Figure 3:
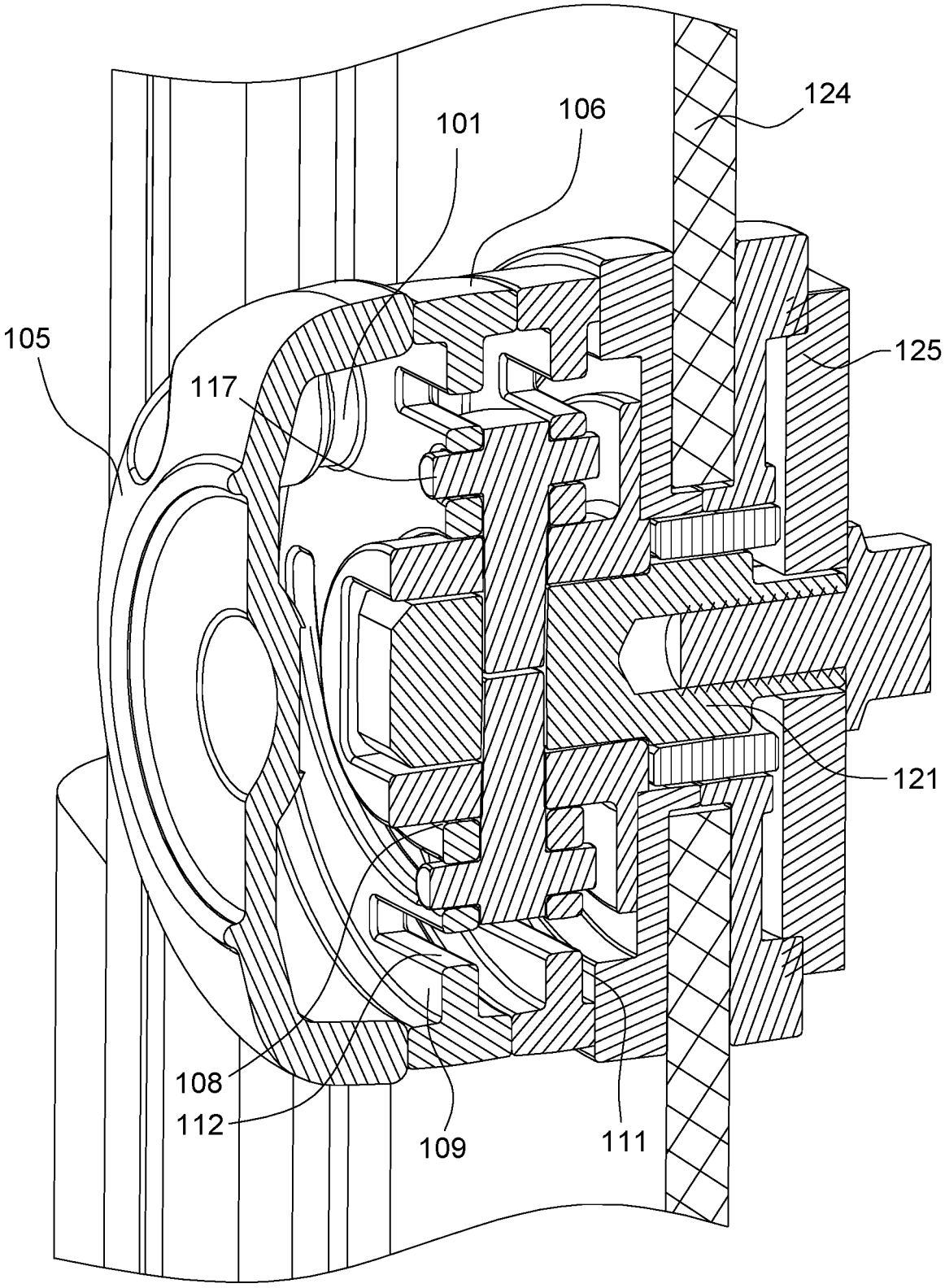
FIG. 3 is a side cross-sectional view of the latch mechanism of FIG. 1 attached to a door assembly according to an embodiment.

Referring to FIGS. 1-3, a latch mechanism 100 for mounting to an internal door panel 124 of a door assembly

Figure 6:
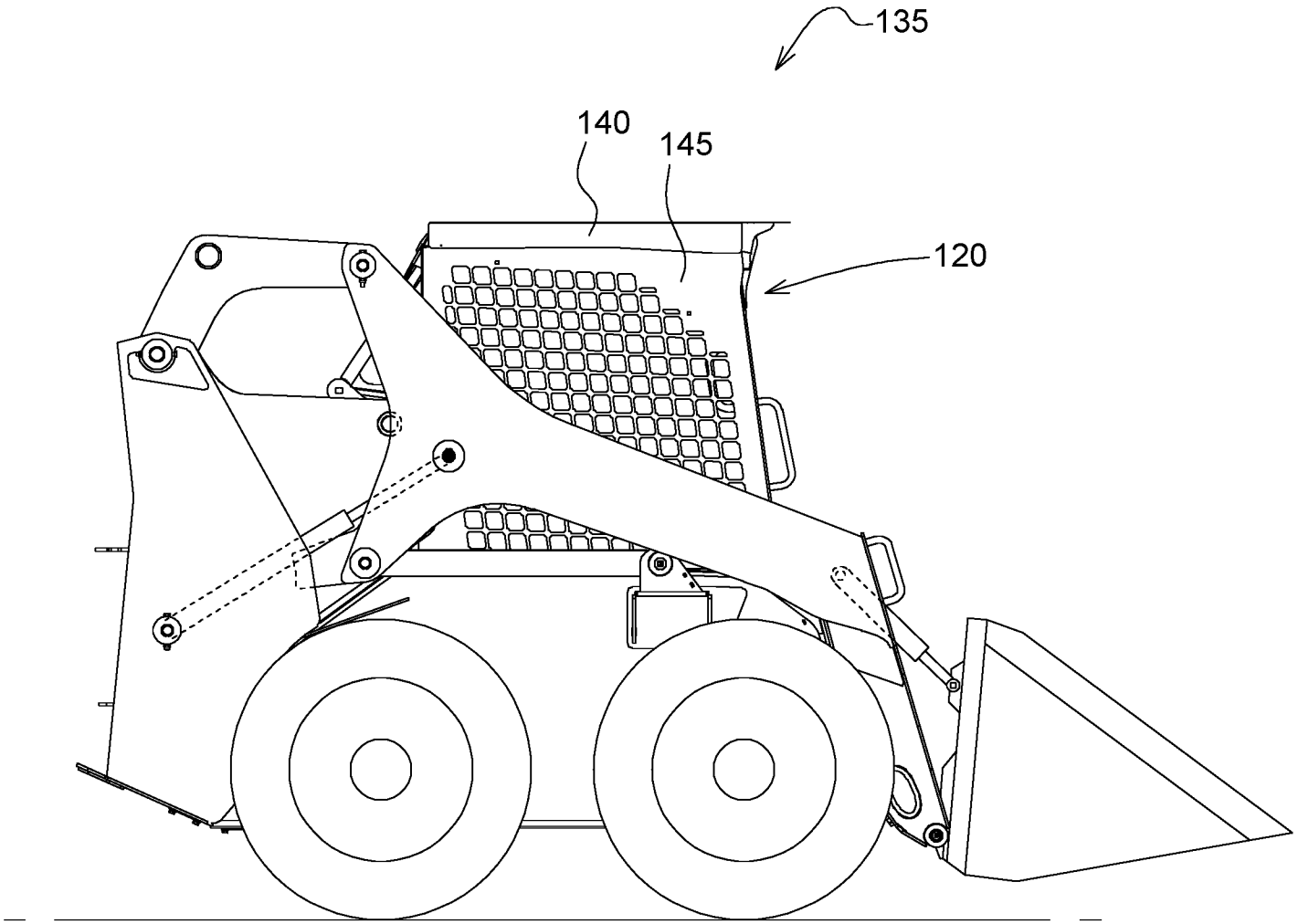
FIG. 6 is a side view of a work vehicle according to an embodiment.

120 is shown according to an embodiment. The universal design of the latch mechanism 100 allows for adaptability to operator cabs 150 (FIG. 6) in a variety of work vehicles, such as skid steers 135 (FIG. 6) or other work vehicles (e.g., compact track loaders, wheel loaders, excavators, tractors, harvesters, and others). In embodiments, the latch mechanism 100 can comprise a first body member 102 removably or integrally coupled to a second body member 104, and a pin element 110 that is arranged to extend axially through the second body member 104.

The first body member 102 can be arranged to form an outer covering of the latch mechanism 100 and can comprise an actuation device 103 for operator engagement. For example, the positioning of the latch mechanism 100 on the door assembly 120 is such that the actuation device 103 is easily accessible to an operator to allow for quick disengagement of the door assembly 120 in emergency situations. Additionally, to withstand extreme temperature conditions, the first body member 102 can comprise a temperature resistant material such as a glass filled polymer or plastic (e.g., a glass filled nylon), or other suitable materials.

As depicted in FIG. 1, in some embodiments, the actuation device 103 can comprise a handle 107 integrally molded with a non-engaging member 105. FIG. 1, however, is but one exemplary embodiment and the geometrical configuration and arrangement of the actuation device 103 may vary according to design and specification requirements. For example, although the actuation device 103 is shown as including a handle 107, in other embodiments, the actuation device 103 can comprise other suitable engagement devices such as latch mechanisms, knobs, levers, combinations thereof, or similar devices.

In some embodiments, the second body member 104 can comprise a single molded housing 106 that is sized and dimensioned relative to the non-engaging member 105 of the actuation device 103. For example, the housing 106 can comprise a geometrical configuration that is substantially similar to that of the non-engaging member 105 to provide for mating engagement of the two components. In embodiments, the housing 106 can comprise a first mounting surface 109 and a second mounting surface 111 oppositely arranged relative to one another with each having distinct coupling features arranged thereon. For example, the first mounting surface 109 can comprise at least two diametrically opposed coupling structures 101 that are arranged in spaced relation to one another for receiving fasteners 129 (refer, e.g., to FIG. 4). The symmetrical arrangement of the coupling structures 101 is particularly advantageous in that it provides for improved stability and a balanced application of forces to the latch mechanism 100 as the actuation device 103 is engaged and disengaged. It should be noted, however, that in other embodiments fewer or more coupling structures 101 can be symmetrically or asymmetrically arranged on the first mounting surface 109. Additionally, although not shown, the second mounting surface 111 can similarly comprise coupling structures or surface features that are configured for engagement to a hinge 125 of the door assembly 120.

As depicted in FIGS. 2 and 3, the housing 106 can comprise an aperture 108, which in some embodiments can be centrally arranged within the housing 106, that is sized to receive and accommodate a shaft 121 of the hinge 125 of the door assembly 120. At least one pin receiving structure 112 can be formed in the housing 106 to facilitate axial movement of the pin element 110 within the pin receiving structure 112 to engage and disengage the pin element 110 to and from the shaft 121. This allows for easy re-assembly due to no internal spring designs which commonly causes difficult re-assembly or lost parts on conventional devices. In some embodiments, the pin receiving structure 112 can comprise a first recessed channel 113 and a second recessed channel 115, each of which extends from an outer periphery of the aperture 108 to a predetermined point arranged on the pin receiving structure 112 as shown in FIG. 2. Additionally, as will be discussed in further detail with reference to FIGS. 3 and 4, the housing 106 can further comprise a set of first cutouts 205*a*, 205*b* and a set of second cutouts 207*a*, 207*b* formed within the housing 106, each of which are associated with the pin element 110.

With respect to FIGS. 1-3, it will be appreciated by those skilled in the art that FIGS. 1-3 are not drawn to scale and is for illustrative purposes only to demonstrate exemplary embodiments of the present disclosure. Notably, the structural layout, sizing, and interconnection of the various components can and will vary in other embodiments. For example, in some embodiments, the design and dimensions of the actuation device 103 can vary as discussed above. Further, in other embodiments, the latch mechanism 100 can comprise fewer or more pin elements 110.

Figure 4:
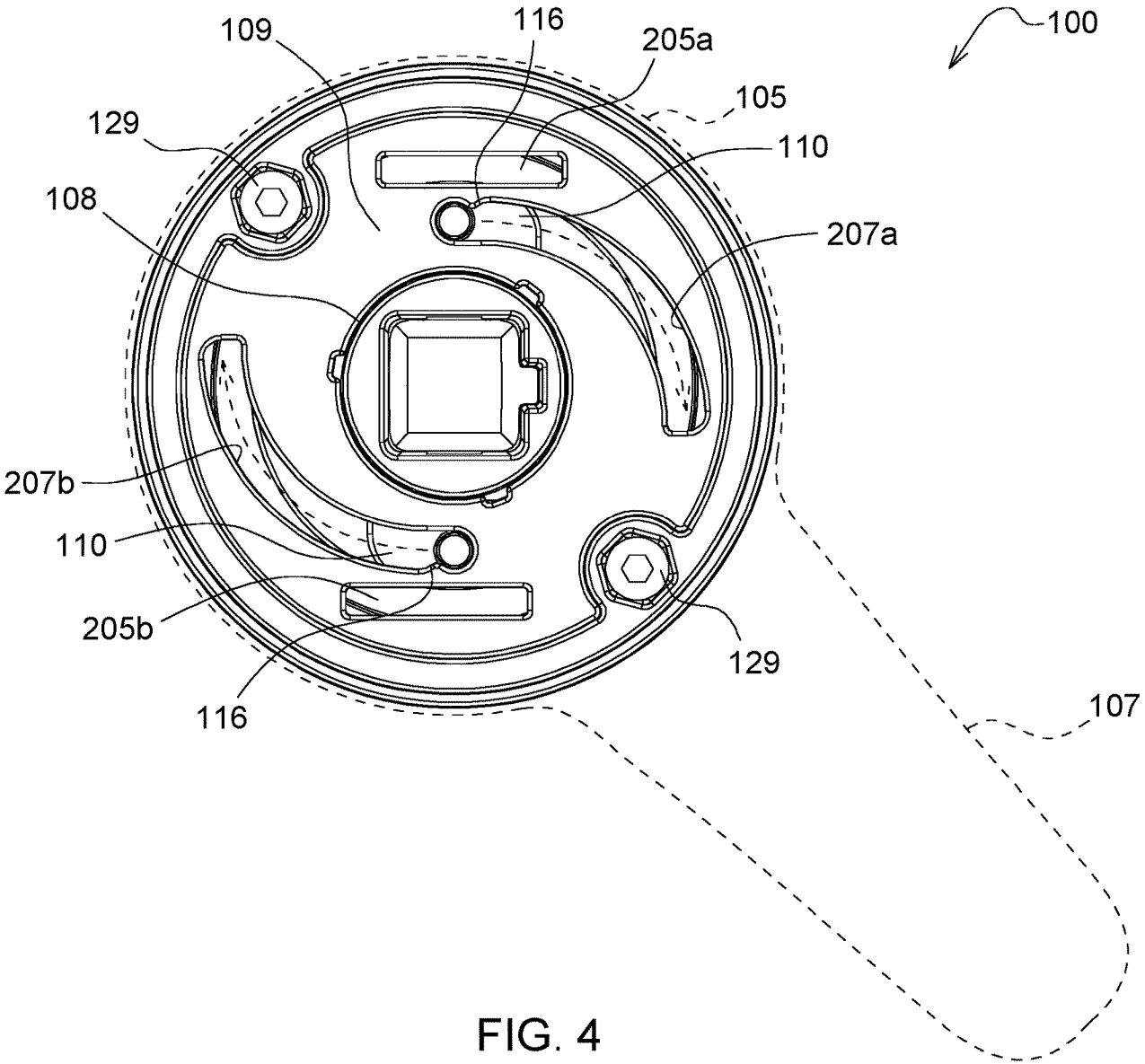
FIG. 4 is a front cross-sectional view of the latch mechanism of FIG. 1 according to an embodiment.

Referring now to FIG. 4, a front cross-sectional view of the latch mechanism 100 is shown according to an embodiment. As depicted, each of the individual cutouts arranged in the first and second cutouts 205*a*, 205*b*, 207*a*, and 207*b* can be equidistantly spaced apart from one another and arranged on opposing sides of the second body member 104. In some embodiments, the first cutouts 205*a*, 205*b* can comprise a generally rectangular configuration that provides relief for the pin element 110 to move past a detent mechanism 116 arranged within the second cutouts 207*a*, 207*b* and to disengage the latch mechanism 100 from the door assembly 120. For example, the detent mechanism 116 can be disposed on at least one end of the second cutouts 207*a*, 207*b* and can comprise a notch feature to prevent incidental rotation of the latch mechanism 100 in a locked position (i.e., a first position). In embodiments, the second cutouts 207*a*, 207*b* can be sized to accommodate an end portion 117 (FIG. 3) of the pin element 110 and can be dimensioned lengthwise such that actuation of the actuation device 103 rotates the latch mechanism 100 approximately a quarter turn.

Figure 5:
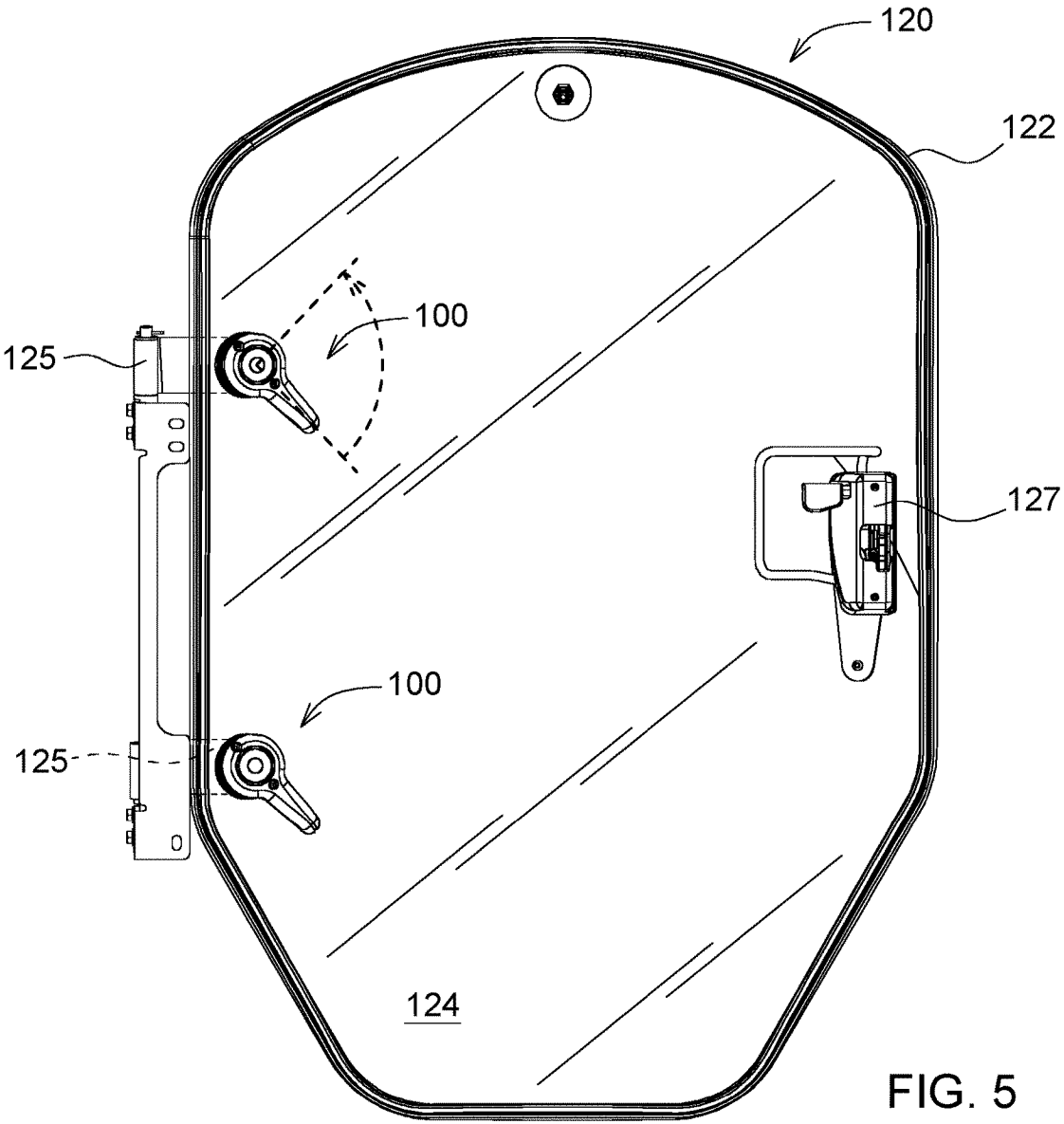
FIG. 5 is a front view of a latch mechanism assembly attached to a door assembly according to an embodiment.

Referring now to FIG. 5, a door assembly 120 incorporating the latch mechanism 100 in accordance with the various embodiments discussed herein is shown. The door assembly 120 can comprise a door frame 122 having a window glass 123 arranged therein that forms the internal door panel 124. The door frame 122 can be pivoted on a vehicle body 140 (FIG. 6) by means of the hinges 125 that are arranged for coupling to a frame 145 of the vehicle body. With reference to FIG. 5, a locking apparatus 127 is mounted to the door panel 124 and is used as the primary access device separate from the latch mechanism 100 during normal operation and non-emergency circumstances.

In operation, the latch mechanism 100 operably works together with the shaft 121 to release the door hinges 125 from the window glass 123 (i.e., inside panel) by disengaging the pin element 110 from the shaft 121. For example, once an operator engages the actuation device 103 and turns the handle 107 a predetermined amount (e.g., a quarter turn), the pin element 110 is released, which in turn allows the operator to push the window glass for quick exit of the work vehicle in emergency situations.

Another key feature of the latch mechanism 100 is that rotation of the actuation device 103 is performed in an upward counterclockwise motion to release door assembly 120 as indicated by the arrow 130 in FIG. 5, whereas other conventional approaches utilize downward clockwise release in an area that is commonly grasped during standard ingress and egress of the operator cab 150. Additionally, as previously discussed, to avoid inadvertent disengagement and release, the detent mechanism 116 is included as a safety feature to prevent the pin element 110 from being prematurely disengaged if the latch mechanism 100 is accidentally bumped by an operator.

Without in any way limiting the scope, interpretation, or application of the claims appearing below, a technical effect of one or more of the example embodiments disclosed herein is a latch mechanism for use with a door assembly of a work vehicle operator cab. The present disclosure is particularly advantageous in that it is cost effective and allows for quick release of the door assembly of the operator cab in emergency situations.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A latch mechanism for coupling a door assembly to a work vehicle, the latch mechanism comprising:

a first body member comprising an actuation device;

a second body member coupled to the first body member; the second body member having an aperture and a first pin receiving channel and a second pin receiving channel formed therein; and a pin element coupled to the second body member, the pin element comprising a first pin portion and a second pin portion respectively arranged to extend axially in the first pin receiving channel and the second pin receiving channel of the second body member, and wherein an upward rotation of the actuation device in a counterclockwise direction moves the second pin portion to releasably disengage the first pin portion from a shaft coupled to one or more hinges of the door assembly to allow an operator to exit an operator cab of the work vehicle.

2. The latch mechanism of claim 1, wherein the second body member comprises a detent mechanism formed on at least one surface of the second body member to inhibit inadvertent rotation of the actuation device.

3. The latch mechanism of claim 1, wherein the first pin receiving channel and the second pin receiving channel comprises a first receiving portion and a second receiving portion.

4. The latch mechanism of claim 3, wherein the pin element is movable between a first position and a second position in each of the first receiving portion and the second receiving portion.

5. The latch mechanism of claim 4, wherein the first position corresponds to a locked position whereby the pin element is positioned in the shaft of the one or more hinges.

6. The latch mechanism of claim 4, wherein the second position corresponds to a disengaged position whereby the pin element is slidably released from the shaft.

7. The latch mechanism of claim 1, wherein the upward rotation of the actuation device corresponds to a quarter turn rotation of the actuation device.

8. A door assembly coupled to an operator cab of a work vehicle, the door assembly comprising:

a door frame;

a door panel;

a latch mechanism coupled to the door panel via one or more hinges, wherein the latch mechanism comprises:

a first body member comprising an actuation device;

a second body member coupled to the first body member; the second body member having an aperture and a first pin receiving channel and a second pin receiving channel formed therein; and a pin element coupled to the second body member, the pin element comprising a first pin portion and a second pin portion respectively arranged to extend axially in the pin receiving channel of the second body member, and wherein an upward rotation of the actuation device in a counterclockwise direction moves the second pin portion to releasably disengage the first pin portion from a shaft coupled to the one or more hinges of the door assembly to allow an operator to exit an operator cab of the work vehicle.

9. The door assembly of claim 8, wherein the second body member comprises a detent mechanism formed on at least one surface of the second body member to inhibit inadvertent rotation of the actuation device.

10. The door assembly of claim 8, wherein the each of the first pin receiving channel and the second pin receiving channel comprises a first receiving portion and a second receiving portion.

11. The door assembly of claim 10, wherein the pin element is movable between a first position and a second position in each of the first receiving portion and the second receiving portion.

12. The door assembly of claim 11, wherein the first position corresponds to a locked position whereby the pin element is positioned in the shaft of the one or more hinges.

13. The door assembly of claim 11, wherein the second position corresponds to a disengaged position and the pin element is slidably released from the shaft.

14. The door assembly of claim 8, wherein the upward rotation of the actuation device corresponds to a quarter turn rotation of the actuation device.

15. A work vehicle comprising:

a door frame;

a door panel;

a latch mechanism coupled to the door panel via one or more hinges, wherein the latch mechanism comprises:

a first body member comprising an actuation device;

a second body member coupled to the first body member; the second body member having an aperture and a first pin receiving channel and a second pin receiving channel formed therein; and a pin element coupled to the second body member, the pin element comprising a first pin portion and a second pin portion respectively arranged to extend axially in the first pin receiving channel and the second pin receiving channel of the second body member, and wherein an upward rotation of the actuation device in a counterclockwise direction moves the second pin portion to releasably disengage the first pin portion from a shaft coupled to the one or more hinges of the door assembly to allow an operator to exit an operator cab of the work vehicle.

16. The work vehicle of claim 15, wherein the second body member of the latch mechanism comprises a detent mechanism formed on at least one surface of the second body member to inhibit inadvertent rotation of the actuation device.

17. The work vehicle of claim 15, wherein the first pin receiving channel and the second pin receiving channel arranged in the second body member of the latch mechanism comprises a first receiving portion and a second receiving portion.

18. The work vehicle of claim 17, wherein the pin element is movable between a first position and a second position in each of the first receiving portion and the second receiving portion.

19. The work vehicle of claim 18, wherein the first position corresponds to a locked position, and wherein the second position corresponds to a disengaged position.

20. The work vehicle of claim 15, wherein the upward rotation of the actuation device of the first body member of the latch mechanism corresponds to a quarter turn rotation of the actuation device.

* * * * *